US006162116A

United States Patent [19]

Zuniga et al.

[11] Patent Number: 6,162,116

[45] Date of Patent: Dec. 19, 2000

[54] CARRIER HEAD FOR CHEMICAL MECHANICAL POLISHING

[75] Inventors: Steven Zuniga, Soquel; Hung Chen, San Jose, both of Calif.

[73] Assignee: Applied Materials, Inc., Santa Clara, Calif.

[21] Appl. No.: 09/236,187

[22] Filed: Jan. 23, 1999

[51] Int. Cl.[7] ..... B24B 5/00

[52] U.S. Cl. ..... 451/285; 451/397; 451/398; 451/288

[58] Field of Search ..... 457/41, 285, 287, 457/288, 397, 398

[56] References Cited

U.S. PATENT DOCUMENTS

| | | | |
|---|---|---|---|
| 4,918,869 | 4/1990 | Kitta . | |
| 5,193,316 | 3/1993 | Olmstead . | |
| 5,205,082 | 4/1993 | Shendon et al. . | |
| 5,423,716 | 6/1995 | Strasbaugh . | |
| 5,449,316 | 9/1995 | Strasbaugh | 451/287 |
| 5,584,751 | 12/1996 | Kobayashi et al. . | |
| 5,624,299 | 4/1997 | Shendon | 451/285 |
| 5,643,053 | 7/1997 | Shendon . | |
| 5,643,061 | 7/1997 | Jackson et al. . | |
| 5,759,918 | 6/1998 | Hoshizaki et al. . | |
| 5,803,799 | 9/1998 | Volodarsky et al. . | |
| 5,851,140 | 12/1998 | Barnes et al. | 451/288 |
| 5,879,220 | 3/1999 | Hasegawa et al. | 451/288 |
| 5,957,751 | 9/1999 | Govzman et al. . | |
| 5,964,653 | 10/1999 | Perlov et al. | 451/285 |

FOREIGN PATENT DOCUMENTS

| | | |
|---|---|---|
| 0 841 123 A1 | 5/1998 | European Pat. Off. . |
| 2243263 | 9/1990 | Japan . |
| WO 99/07516 | 2/1999 | WIPO . |

*Primary Examiner*—Eileen P. Morgan
*Attorney, Agent, or Firm*—Fish & Richardson

[57] ABSTRACT

A carrier head for a chemical mechanical polishing apparatus includes a base and a flexible membrane extending beneath the base to define a pressurizable chamber. The flexible membrane may be secured to the base, to a retaining ring surrounding the mounting surface, or to a support structure movably connected to the base by, for example, an adhesive, an O-ring seal, a sealant, or by fitting the membrane into a recess. A lower surface of the flexible membrane provides a mounting surface for a substrate.

7 Claims, 9 Drawing Sheets

CARRIER HEAD FOR CHEMICAL MECHANICAL POLISHING

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate.

A polishing slurry, including at least one chemically-reactive agent, and abrasive particles, if a standard pad is used, is supplied to the surface of the polishing pad. The chemical and mechanical interaction between the polishing pad, slurry and substrate results in polishing.

One problem, particularly in a carrier head with a flexible membrane, relates to the attachment of the flexible membrane to the carrier head. Typically, the flexible membrane is secured to the carrier head with a clamping ring. Unfortunately, there are a variety of potential problems with this arrangement, such as difficulty in securing the clamping ring or ensuring that the seal between the flexible membrane and carrier head is fluid-tight.

SUMMARY

In general, in one aspect, the invention is directed to a carrier head for a chemical mechanical polishing apparatus including a base, a support structure movably connected to the base, and a flexible membrane. The support structure has an outer surface and a recess formed in the outer surface. The flexible membrane extends beneath the base to define a pressurizable chamber, and a lower surface of the flexible membrane provides a mounting surface for a substrate. An edge portion of the flexible membrane extends into the recess and a sealant in the recess secures the flexible membrane to the support structure.

Implementations of the invention may include one or more of the following. The edge portion of the flexible membrane may extend along the outer surface of the support structure. The sealant may be injected in a liquid state into the recess. A plurality of ports may be formed between an upper surface of the support structure and the recess.

In another aspect, the invention is directed to a carrier head for a chemical mechanical polishing apparatus including a base, a support structure movably connected to the base, and a flexible membrane. The support structure has an outer surface and a recess formed in the outer surface. The flexible membrane extends beneath the base to define a pressurizable chamber. A lower surface of the flexible membrane provides a mounting surface for a substrate. The rim portion of the flexible membrane engages the recess to form an O-ring seal between the flexible membrane and the support structure.

Implementations of the invention may include the following. The rim portion of the flexible membrane may have a diameter in an unstretched state which is less than a diameter of the recess in the outer surface of the support structure. The flexible membrane may include an edge portion that may extend along the outer surface of the support structure.

In another aspect, the invention is directed to a carrier head for a chemical mechanical polishing apparatus including a base, a support structure movably connected to the base, and a flexible membrane. The support structure has an outer surface and a recess formed in the outer surface. The flexible membrane extends beneath the base to define a pressurizable chamber. A lower surface of the flexible membrane provides a mounting surface for a substrate. An edge portion of the flexible membrane extends into the recess. The edge portion and recess are configured such that if the chamber is pressurized, the edge portion is pressed against a first surface of the recess to form a seal between the flexible membrane and the support structure. When the chamber is evacuated, the edge portion is pulled against a second surface of the recess to form a seal between the flexible membrane and the support structure.

Implementations of the invention may include the following. The recess may be disposed in a generally horizontal arrangement. The first surface may be a top surface of the recess and the second surface may be a bottom surface of the recess.

In another aspect, the invention is directed to a carrier head for a chemical mechanical polishing apparatus including a base, a support structure movably connected to the base, and a flexible membrane. The support structure has an outer surface and a recess formed in the outer surface. The flexible membrane extends beneath the base to define a pressurizable chamber. The lower surface of the flexible membrane provides a mounting surface for a substrate, and a rim portion of the flexible membrane is adhesively attached to the support structure.

Implementations of the invention may include the following. The flexible membrane may have an edge portion that extends around the outer surface of the support structure. The rim portion of the flexible membrane may be adhesively attached to a top surface of the support structure.

In another aspect, the invention is directed to a carrier head for a chemical mechanical polishing apparatus including a base, a flexible membrane that extends beneath the base to define a pressurizable chamber, and a retaining ring. A lower surface of the flexible membrane provides a mounting surface for a substrate. The retaining ring has an inner surface surrounding the mounting surface and a recess formed in the inner surface. An edge portion of the flexible membrane extends into the recess. The sealant in the recess secures the flexible membrane to the retaining ring.

Implementations of the invention may include the following. The sealant may be injected in a liquid state into the recess. A plurality of injection ports may be formed between an upper surface of the retaining ring and the recess. The flexible membrane may extend along the inner surface of the retaining ring.

In another aspect, the invention is directed to a carrier head for a chemical mechanical polishing apparatus including a base, a flexible membrane extends beneath the base to define a pressurizable chamber a lower surface of the flexible membrane provides a mounting surface for a substrate. The retaining ring surrounds the mounting surface, it includes an upper surface and a recess formed in it. The rim portion of the flexible membrane engages the recess to form an O-ring seal between the flexible membrane and the retaining ring.

Implementations of the invention may include the following. The flexible membrane may have an edge portion and may extend along the inner surface of the retaining ring.

In another aspect, the invention is directed to a carrier head for a chemical mechanical polishing apparatus including a base, a flexible membrane extends beneath the base to define a pressurizable chamber. The lower surface of the flexible membrane provides a mounting surface for a substrate. The retaining ring includes an inner surface surrounding the mounting surface and a recess formed in the inner surface. The edge portion of the flexible membrane extends into the recess. The edge portion and recess are configured such that if the chamber is pressurized, the edge portion is pressed against a first surface of the recess to form a seal between the flexible membrane and the retaining ring. If the chamber is evacuated, the edge portion is pulled against a second surface of the recess to form a seal between the flexible membrane and the retaining ring.

Implementations of the invention may include the following. The recess may be horizontal. The first surface may be a top surface, and the second surface may be a bottom surface of the recess.

In another aspect, the invention is directed to a carrier head for a chemical mechanical polishing apparatus including a base, a flexible membrane extends beneath the base to define a pressurizable chamber, a lower surface of the flexible membrane provides a mounting surface for a substrate. The retaining ring surrounds the mounting surface. The edge portion of the flexible membrane extends along an inner surface of the retaining ring and a rim portion of the flexible membrane is adhesively attached to a top surface of the retaining ring.

In another aspect, the invention is directed to a carrier head for a chemical mechanical polishing apparatus including a base which had an outer surface and a recess formed in the outer surface. The flexible membrane extends beneath the base to define a pressurizable chamber. A lower surface of the flexible membrane provides a mounting surface for a substrate. The rim portion of the flexible membrane engages the recess to form an O-ring seal between the flexible membrane and the base.

Implementations of the invention may include the following. The retaining ring may surround the mounting surface. The rim portion of the flexible membrane may have a diameter in an unstretched state which may be less than a diameter of the recess in the outer surface of the base.

In another aspect, the invention is directed to a carrier head for a chemical mechanical polishing apparatus including a base which has a lower surface and a recess formed in the lower surface. The flexible membrane extends beneath the base to define a pressurizable chamber. The lower surface of the flexible membrane provides a mounting surface for a substrate. The edge portion of the flexible membrane extends into the recess, it is configured so that if the chamber is pressurized, the edge portion is pressed against a first surface of the recess to form a seal between the flexible membrane and the base. If the chamber is evacuated, the edge portion is pulled against a second surface of the recess to form a seal between the flexible membrane and the base.

Implementations of the invention may include the following. The retaining ring may surround the mounting surface. The recess may be vertical. The first surface may be an outer surface, and the second surface may be an inner surface of the recess.

Advantages of the invention may include the following. The membrane is easy to install and remove, with reduced chance of assembly errors and reduced time to change the membrane. The shape of the retaining ring should not distort when the membrane is installed. The membrane assembly accommodates retaining ring wear, i.e., the pressure applied by the membrane should not change as the lower surface of the retaining ring is worn away. The membrane may be removed without removing the retaining ring. A reliable fluid-tight seal is formed between the flexible membrane and the support plate, retaining ring or base. The membrane may "self-align", i.e., pressurization of the chamber will naturally cause the membrane to move into the proper position for polishing. The membrane assembly has a low manufacturing cost. The membrane and the retaining ring or support structure may form a unitary part that is easy to install.

Other advantages and features of the invention will be apparent from the following description, including the drawings and claims.

BRIEF DESCRIPTION OF THE DRAWINGS

Like reference numbers are designated in the various drawings to indicate like elements. A reference number with a letter suffix indicates that an element has a modified function, operation or structure.

DETAILED DESCRIPTION

Figure 1:
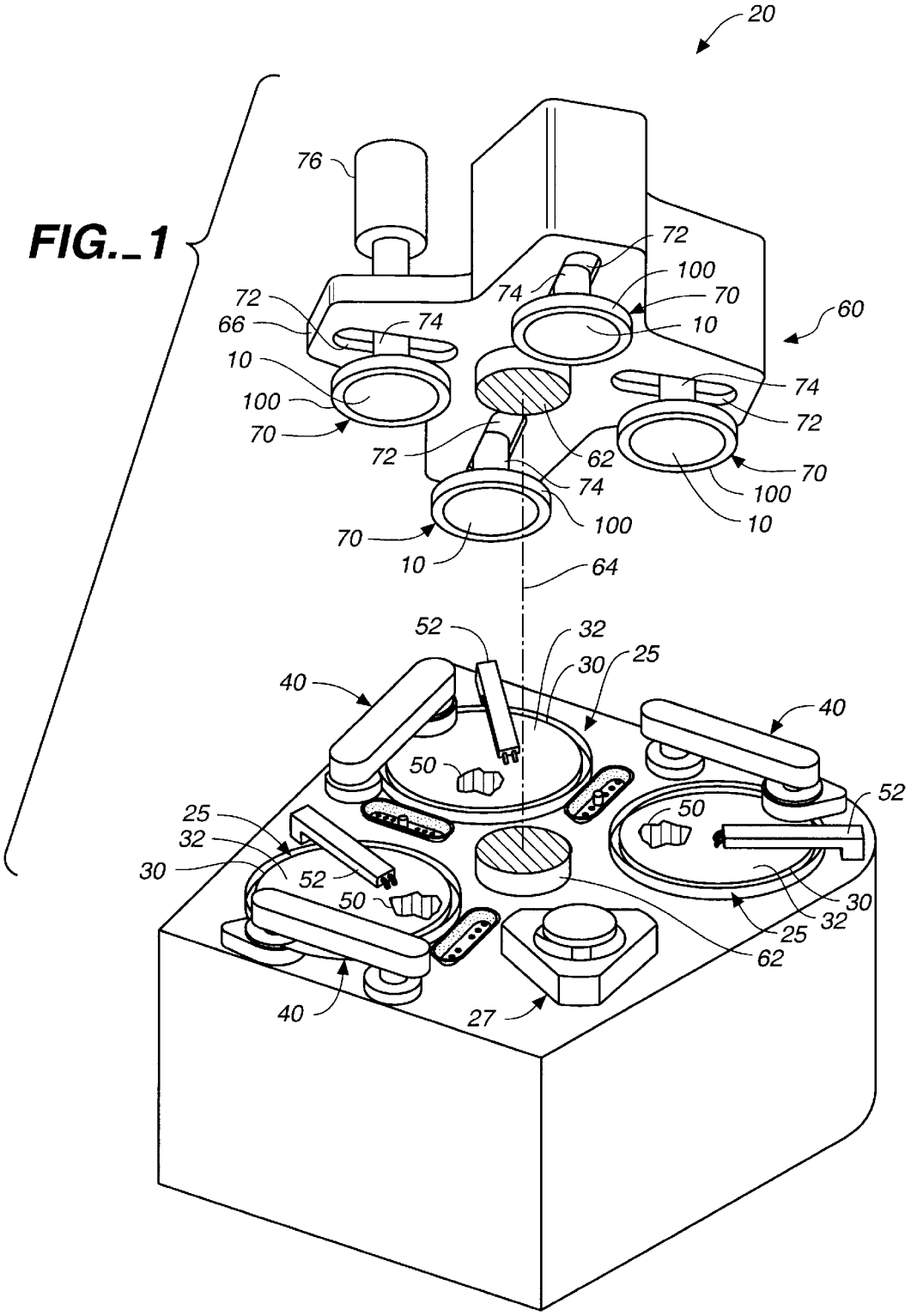
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) which, for most polishing processes, rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66, is supported by a center post 62 and rotated about a carousel axis 64 by a carousel. motor assembly (not shown). Multi-head carousel 60 includes four carrier head systems 70 mounted on carousel support plate 66. Three of the carrier head systems receive and hold substrates and polish them by pressing them against the polishing pads of polishing stations 25. One of the carrier head systems receives a substrate from and delivers the substrate to transfer station 27. The carousel motor may orbit the carrier head systems, and the substrates attached thereto, about carousel axis 64 between the polishing stations and the transfer station.

Each carrier head system includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 to carrier head 100. There is one carrier drive shaft and motor for each head. Each motor and drive shaft may be supported on a slider (not shown) which can be linearly driven along the slot by a radial drive motor to laterally oscillate the carrier heads.

Figure 2:
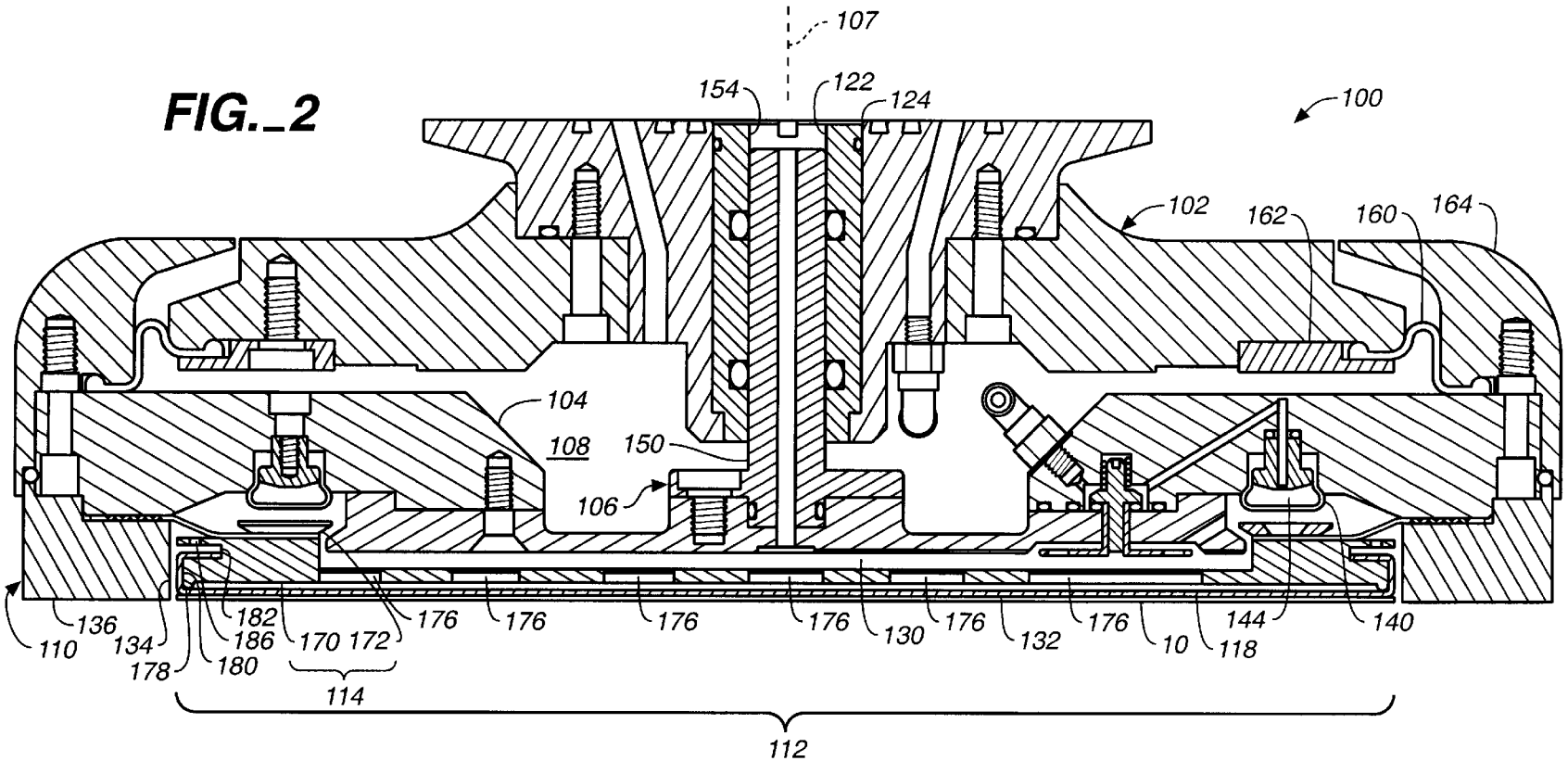
FIG. 2 is a schematic cross-sectional view of a carrier head according to the present invention.
Figure 3A:
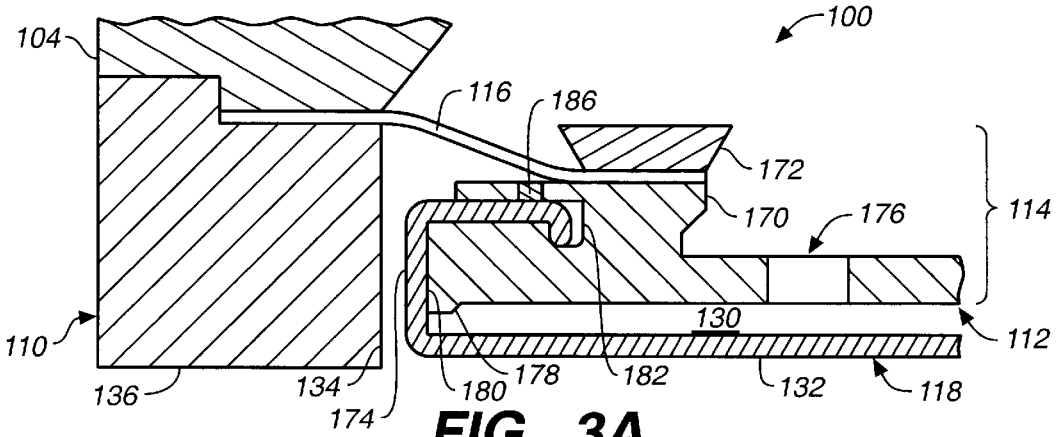
FIG. 3A is an enlarged view of the carrier head of FIG. 2 showing an injection molded connection between a flexible membrane and a support structure.

Referring to FIGS. 2 and 3A, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/861,260 by Zuniga, et al., filed May 21, 1997, entitled A CARRIER HEAD WITH A FLEXIBLE MEMBRANE FOR A CHEMICAL MECHANICAL POLISHING SYSTEM, and assigned to the assignee of the present invention, the entire disclosure of which is hereby incorporated by reference.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A cylindrical bushing 122 may fit into a vertical bore 124 through the housing.

Base 104 is a generally ring-shaped or disk-shaped body located beneath housing 102 and formed of a rigid material. An elastic and flexible membrane 140 may be attached to the lower surface of base 104 to define a bladder 144. A first pump (not shown) may be connected to bladder 144 to direct a fluid, e.g., a gas, such as air, into or out of the bladder and thereby control a downward pressure on support structure 114.

An inner edge of a ring-shaped rolling diaphragm 160 is clamped to housing 102 by an inner clamp ring 162, and an outer edge of rolling diaphragm 160 is clamped to base 104 by an outer clamp ring 164. Thus, rolling diaphragm 160 seals the space between housing 102 and base 104 to define loading chamber 108. A second pump (not shown) may be fluidly connected to loading chamber 108 to control the pressure in the loading chamber and the load applied to base 104. The vertical position of base 104 relative to polishing pad 32 is also controlled by loading chamber 108.

Gimbal mechanism 106 permits base 104 to pivot with respect to housing 102 so that the base may remain substantially parallel with the surface of the polishing pad. Gimbal mechanism 106 includes a gimbal rod 150 which may slide vertically in bushing 122 to provide vertical motion of base 104, while preventing lateral motion and excessive rotation of base 104 with respect to housing 102.

Retaining ring 110 may be a generally annular ring secured at the outer edge of base 104, e.g., by bolts (not shown). When fluid is pumped into loading chamber 108 and base 104 is pushed downwardly, retaining ring 110 is also pushed downwardly to apply a load to polishing pad 32. A bottom surface 136 of retaining ring 110 may be substantially flat, or it may have a plurality of channels to facilitate transport of slurry from outside the retaining ring to the substrate. An inner surface 134 of retaining ring 110 engages the substrate to prevent it from escaping from beneath the carrier head.

Substrate backing assembly 112 is positioned below base 104 and includes a support structure 114, a flexure diaphragm 116 connecting support structure 114 to base 104, and a flexible member or membrane 118 connected to support structure 114. Flexible membrane 118 extends below support structure 114 to provide a mounting surface 132 for the substrate. The sealed volume between flexible membrane 118, support structure 114, flexure diaphragm 116, base 104, and gimbal mechanism 106 defines a pressurizable chamber 130. A third pump (not shown) may be fluidly connected to chamber 130 to control the pressure in the chamber and thus the downward force of the flexible membrane on the substrate.

Support structure 114 of substrate backing assembly 112 includes a support plate 170 and an annular clamp 172.

Support plate 170 may be a rigid disk-shaped member having a plurality of apertures 176 therethrough. Alternately, support plate 170 could be replaced by a ring-shaped member having a central aperture. A generally horizontal annular recess or slot 182 is formed in an outer surface 180 of the support plate, and a plurality of ports or through-holes 184 are formed between a top surface 186 of support plate 170 and the interior of annular slot 182. For example, there may be twelve through-holes spaced at equal angular intervals. Support plate 170 may also have a downwardly-projecting lip 178 at its outer edge.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between support plate 170 and clamp 172. Flexure diaphragm 116 is flexible and elastic, although it could be rigid in the radial and tangential directions.

Flexible membrane 118 is a generally circular sheet formed of a flexible and elastic material. An edge portion 174 of flexible membrane 118 extends along inner surface 134 of retaining ring 110. The edge portion 174 also extends around outer surface 180 of support plate 170 and fits into annular slot 182. To secure the flexible membrane to the support plate, a liquid sealant is injected into through-holes 184 to fill annular slot 182. The liquid sealant may be a room temperature vulcanizing (RTV) rubber or another elastomeric material. The sealant may be formed of the same material as the flexible membrane, e.g., silicone. The sealant is heated or otherwise cured to secure the flexible membrane in the annular slot. Advantages of may include low risk that the shape of the retaining ring will distort when the membrane is installed, the ability to remove the membrane without removing the retaining ring, and a reliable fluid-tight seal between the support plate and the flexible membrane. In addition, this embodiment accommodates retaining ring wear, i.e., the pressure applied by the membrane should not change as the lower surface of the retaining ring is worn away. Furthermore, the membrane and the support structure form a unitary part that is easy to install and which requires little maintenance.

In operation, fluid is pumped into chamber 130 to control the downward pressure applied to the substrate by flexible membrane 118. When polishing is completed, fluid is pumped out of chamber 130 to vacuum chuck the substrate to flexible membrane 118. Then loading chamber 108 is evacuated to lift base 104 and substrate backing assembly 112.

Figure 3B:
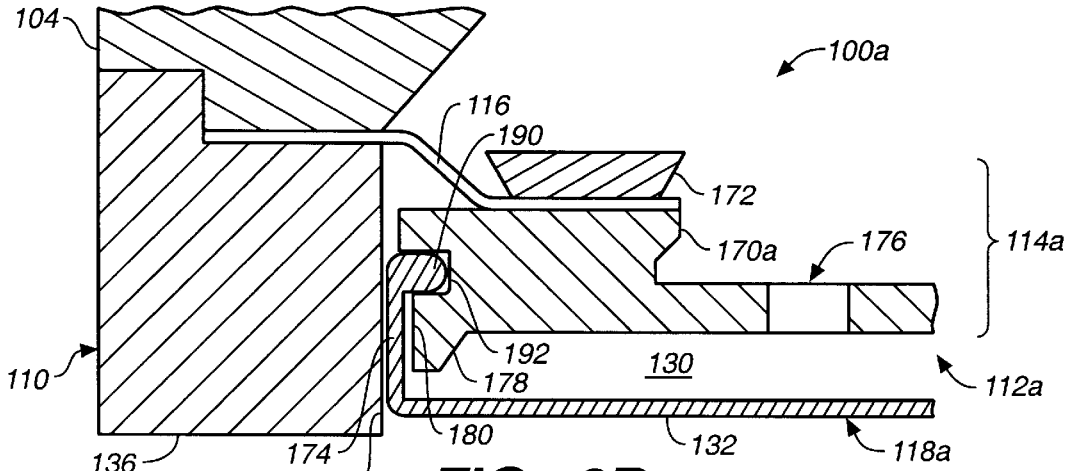
FIG. 3B is a cross-sectional view of a carrier head in which the flexible membrane is snap-fit to the support structure.

Referring to FIG. 3B, a carrier head 100*a* may includes a flexible membrane 118*a* which is snap-fit to a support plate 170*a*. An outer surface 180*a* of support plate 170*a* includes a relatively shallow annular recess 192. Flexible membrane 118*a* includes a thick rim portion 190. In an unstretched state, rim portion 190 has a diameter slightly smaller than the diameter of the outer surface of support plate 170*a*. However, the flexible membrane can be stretched to slide rim portion 190 around the outer surface of support plate 170*a* until rim portion 190 fits into annular recess 192. When rim portion 190 is located in and engages recess 192, it forms an O-ring seal between the support plate and the flexible membrane. The inner surface of the retaining ring and the substrate act to contain the membrane and prevent the O-ring from escaping the recess. Advantages of this embodiment may include ease of installation and removal of the membrane, reduced risk of retaining ring distortion, accommodation of retaining ring wear, a reliable fluid-tight seal between the support plate and the flexible membrane, and a low manufacturing cost.

Figure 3C:
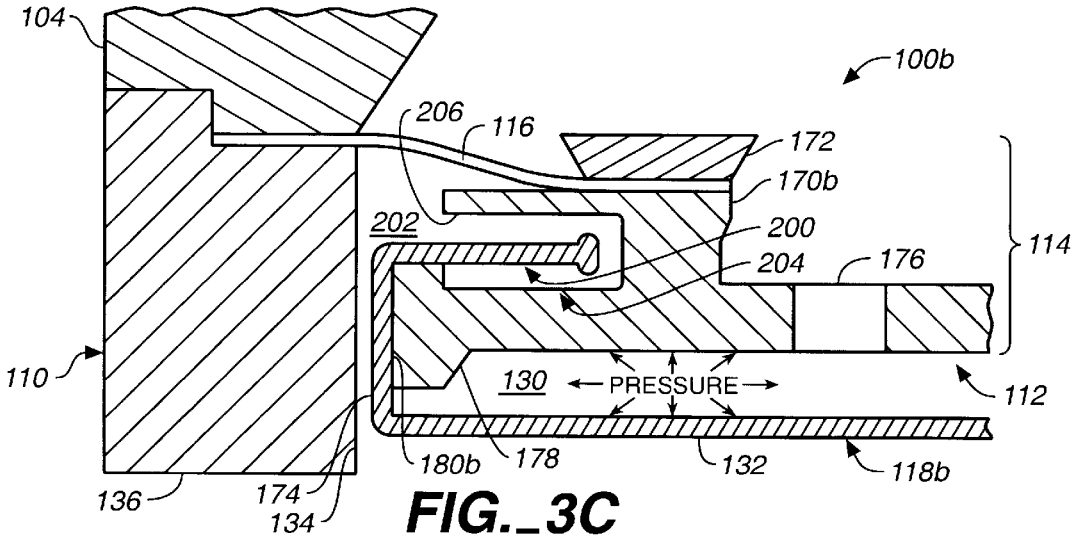
FIG. 3C is a cross-sectional view of a carrier head in which a flap of the flexible membrane fits into a sealing slot in the support structure.

Referring to FIG. 3C, a carrier head 100*b* includes a flexible membrane 118*b* with a flap or edge portion 200 that extends inwardly into a generally annular recess 202 formed in an outer surface 180*b* of a support plate 170*b*. The recess 202 includes a lower sealing surface 204 and an upper sealing surface 206. If chamber 130 is pressurized, flap portion 200 of flexible membrane 118*b* is forced upwardly and into contact with upper sealing surface 206. On the other hand, if chamber 130 is evacuated, flap portion 200 is pulled downwardly into contact with lower sealing surface 204. Thus, flexible membrane 118*b* forms a fluid-tight seal with support plate 170*b*. Advantages of this embodiment include ease of assembly, reduced risk of retaining ring distortion, accommodation of retaining ring wear, "self-alignment" of the membrane, i.e., that pressurization of the chamber will naturally cause the membrane to move into the proper position for polishing, and a low manufacturing cost.

Figure 3D:
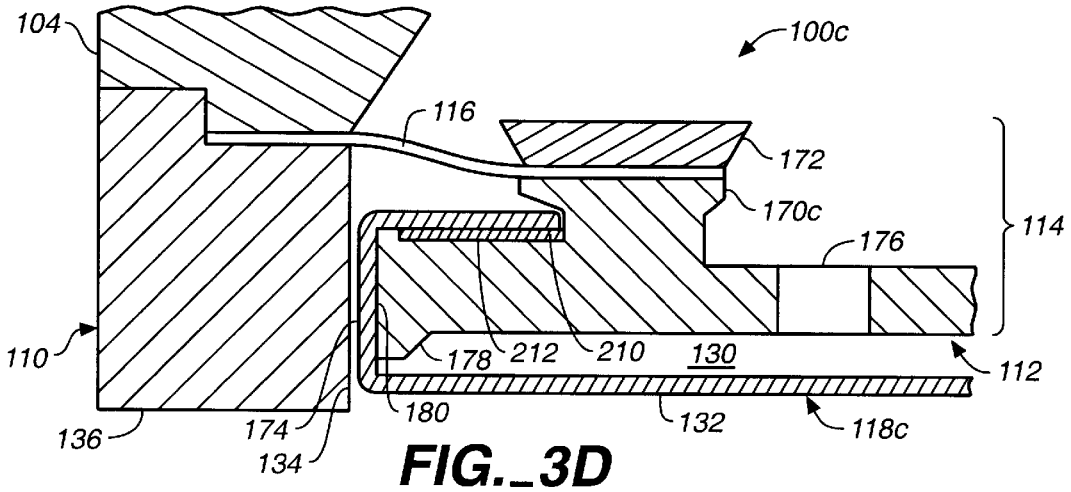
FIG. 3D is a cross-sectional view of a carrier head in which the flexible membrane is adhesively attached to the support structure.

Referring to FIG. 3D, a carrier head 100*c* includes a flexible membrane 118*c* which is secured to a support plate 170*c* with an adhesive layer 210. Specifically, adhesive layer 210 may be placed on an annular outer area 212 of top surface 186 of a support plate 170*c*. The adhesive layer 210 may be an epoxy or a pressure sensitive adhesive. An advantage of the adhesive attachment is that it provides a relatively permanent attachment between the flexible membrane and the support plate so that the membrane and the support structure form a unitary part that is easy to install and which requires little maintenance. Additional advantages of this embodiment may include reduced risk of retaining ring distortion, accommodation of retaining ring wear, and a reliable fluid-tight seal between the support plate and the flexible membrane.

Figure 4:
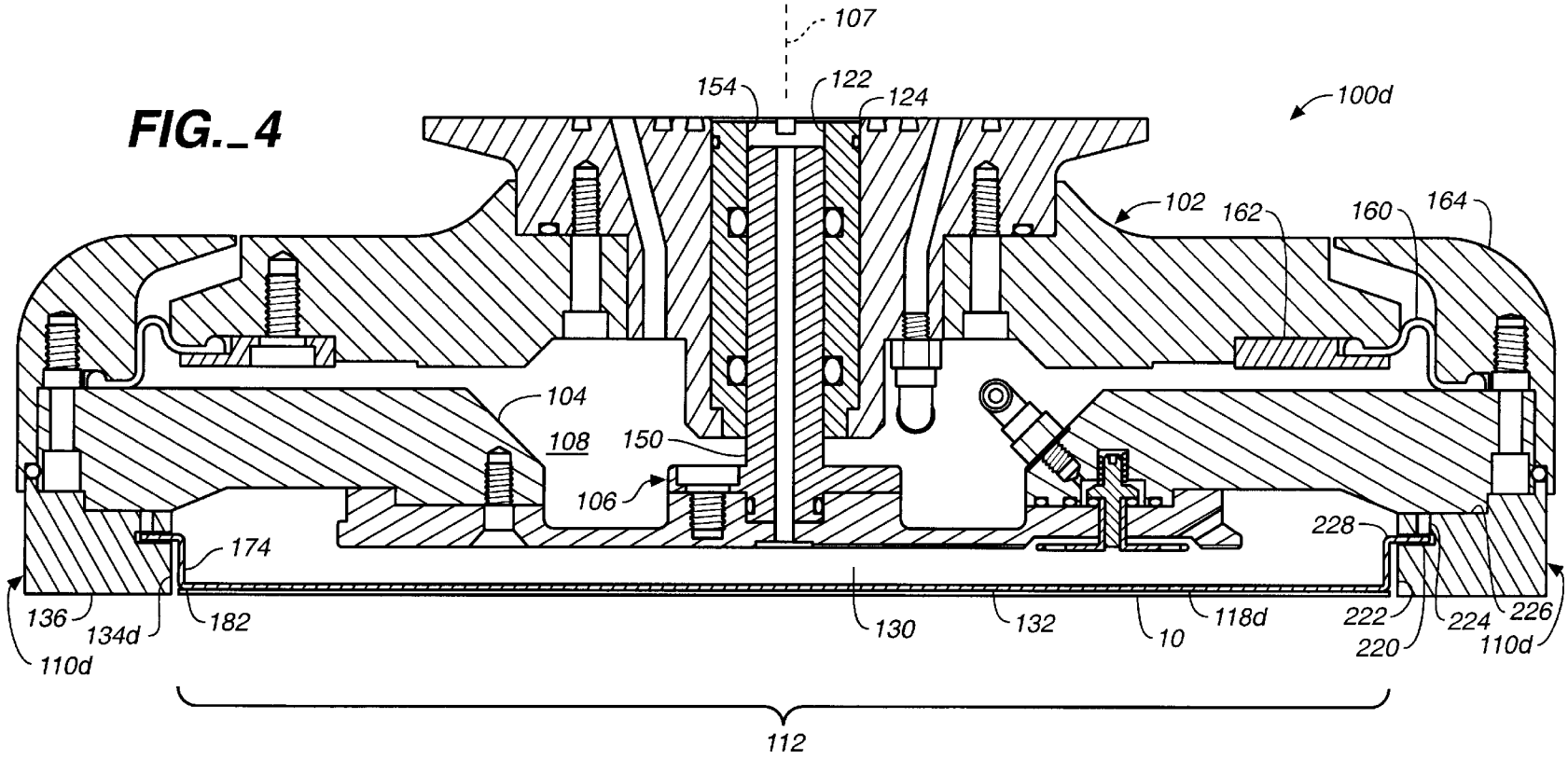
FIG. 4 is a cross-sectional view of a carrier head according to the present invention in which the flexible membrane is attached to the retaining ring.
Figure 5A:
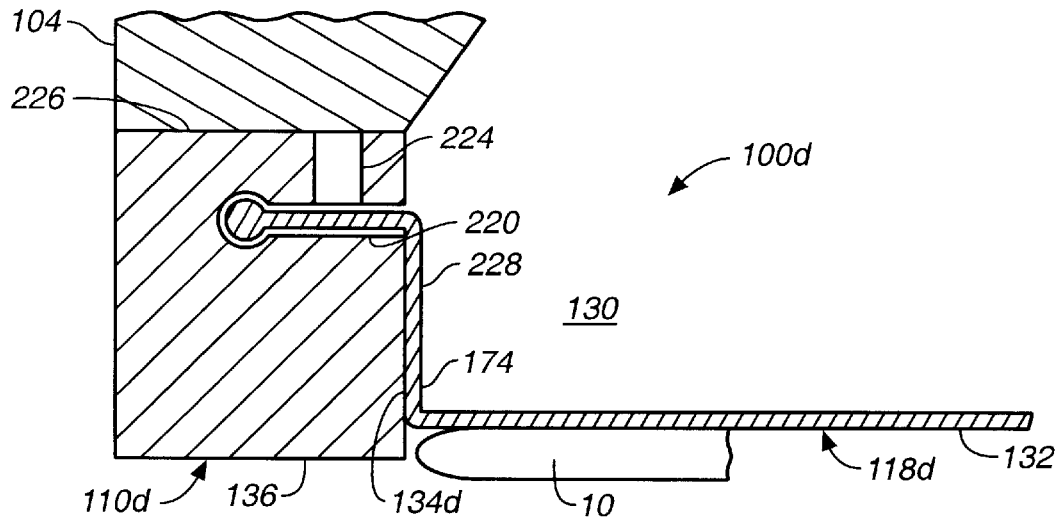
FIG. 5A is an enlarged view of the carrier head and FIG. 4 showing an injection molded connection between the flexible membrane and the retaining ring.

Referring to FIGS. 4 and 5A, a carrier head 100*d* includes a flexible membrane 118*d* that is secured to a retaining ring 110*d*. A generally horizontal annular slot o recess 220 is formed in an inner cylindrical surface 134*d* of the retaining ring. In addition, a plurality of through-holes or ports 224 are formed between an upper surface 226 of retaining ring 110*d* and an annular slot 220. Flexible membrane 118*d* includes a flap or edge portion 228 that extends outwardly into slot 220. To secure the flexible membrane to the retaining ring, a sealant, such as RTV or the membrane material, is injected into through-holes 224 into annular slot 220. The sealant is cured to secure the flexible membrane to the retaining ring. Although carrier head 100*d* is illustrated without a support plate, flexure, or bladder, these elements could be included in the carrier head. Advantages of this embodiment may include a relatively permanent attachment between the flexible membrane and the retaining ring support plate which provides a unitary part that is easy to install and requires little maintenance. Additional advantages of this embodiment may include a reliable fluid-tight seal between the retaining ring and the flexible membrane.

Figure 5B:
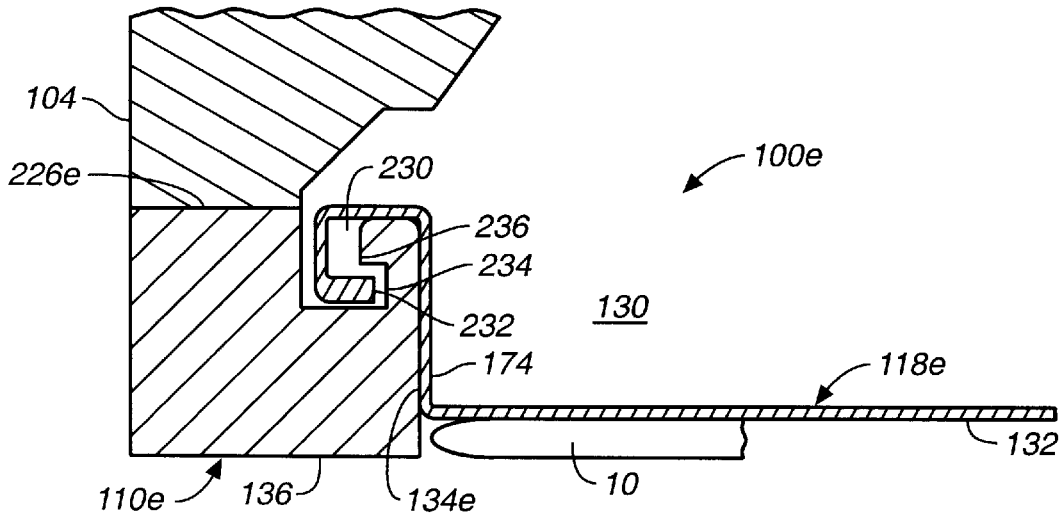
FIG. 5B is a cross-sectional view of a carrier head in which the flexible membrane is snap-fit to the retaining ring.

Referring to FIG. 5B, a carrier head 100*e* includes a flexible membrane 118*e* which is snap-fit to a retaining ring 110*e*. Retaining ring 110*e* includes an annular recess or groove 230 formed in an upper surface 226*e* of the retaining ring. The edge portion 174 of flexible membrane 118*e* extends along an inner surface 134*e* of retaining ring 110*e*, and a flap portion 238 of the flexible membrane extends outwardly across upper surface 226*e* of retaining ring 110*e* and downwardly into annular groove 230. Flexible membrane 118*e* includes a thick rim portion 232 which fits into a relatively shallow recess 234 in an inner surface 236 of annular groove 230. In an unstretched state, the diameter of rim portion 232 may be slightly smaller than the diameter of recess 234. Thus, when flexible membrane 118*e* is stretched over the retaining ring to fit rim portion 232 into recess 234, the flexible membrane forms an O-ring seal with retaining ring 110*e*. Advantages of this embodiment may include ease of assembly, accommodation of retaining ring wear, a reliable fluid-tight seal between the support structure and the flexible membrane, and a low manufacturing cost.

Figure 5C:
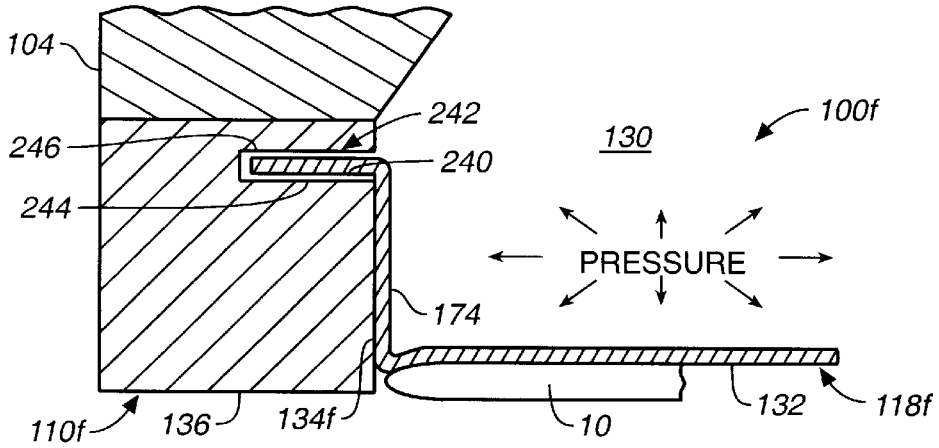
FIG. 5C is a cross-sectional view of a carrier head in which a flap of the flexible membrane fits into a sealing slot in the retaining ring.

Referring to FIG. 5C, a carrier head 100*f* includes a flexible membrane 118*f* which has an edge or flap portion 240 that extends into a generally horizontal annular slot 242 formed in an inner surface 134*f* of a retaining ring 110*f*. When chamber 130 of carrier head 100*f* is pressurized, flap 240 of flexible membrane 118*f* is pressed against a lower surface 244 of annular slot 242. On the other hand, when the chamber 130 of carrier head 100*f* is evacuated, flap 240 of flexible membrane 118*f* is pulled against an upper surface 246 of annular slot 242. Thus, flexible membrane 118*f* forms a fluid-tight seal with the retaining ring. Advantages of this embodiment may include ease of assembly, "self-alignment" of the membrane, and a low manufacturing cost.

Figure 5D:
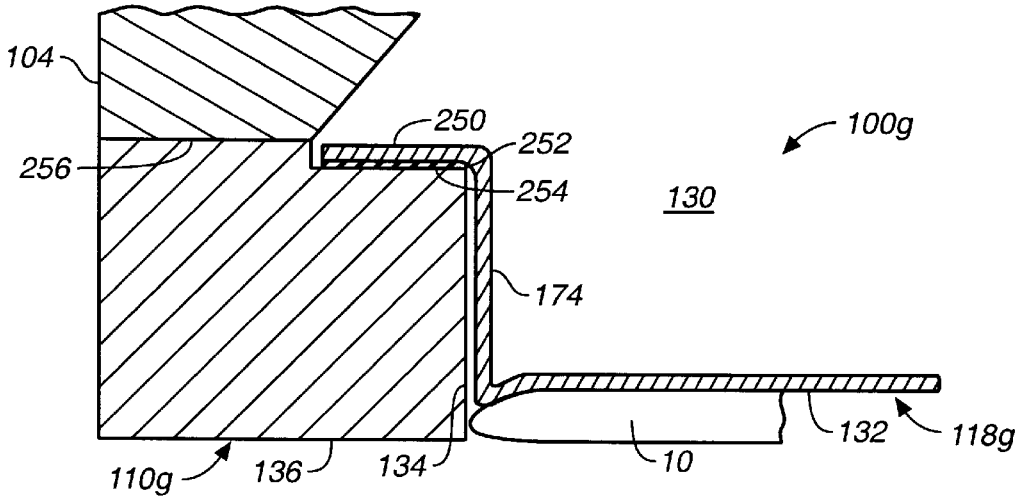
FIG. 5D is a cross-sectional view of a carrier head in which the flexible membrane is adhesively attached to the retaining ring.

Referring to FIG. 5D, a carrier head 100*g* includes a flexible membrane 118*g* which is secured to a retaining ring 110*g* by an adhesive layer 252. Specifically, an edge portion 250 of flexible membrane 118*g* may be secured to a rim 254 formed in an upper surface 256 of the retaining ring. The adhesive layer 252 may be an epoxy or pressure-sensitive adhesive. Advantages of this embodiment may include a unitary part that is easy to install, and a reliable fluid-tight seal between the retaining ring and the flexible membrane.

Figure 6:
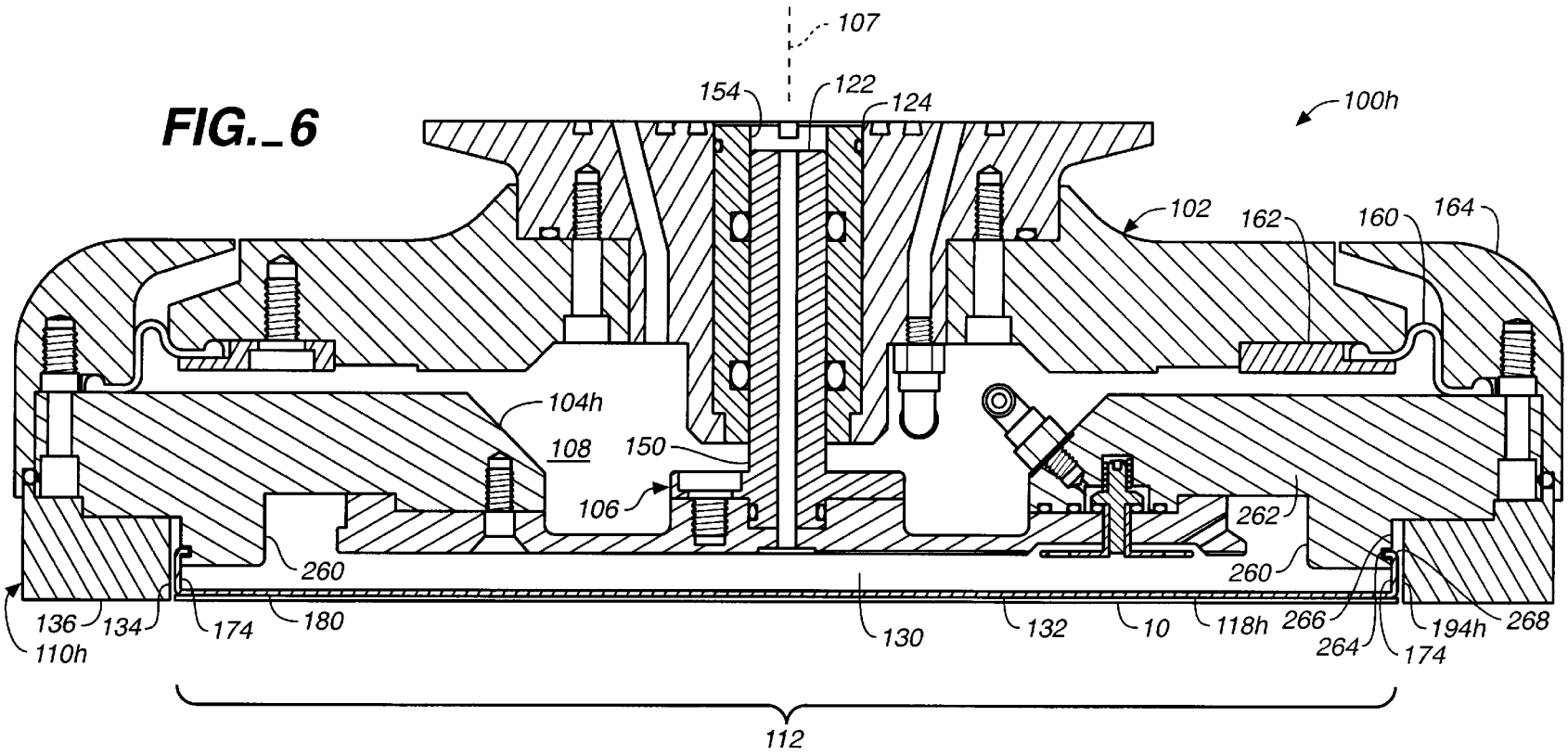
FIG. 6 is a cross-sectional view of a carrier head according to the present invention in which a flexible membrane is attached to a carrier base.
Figure 7A:
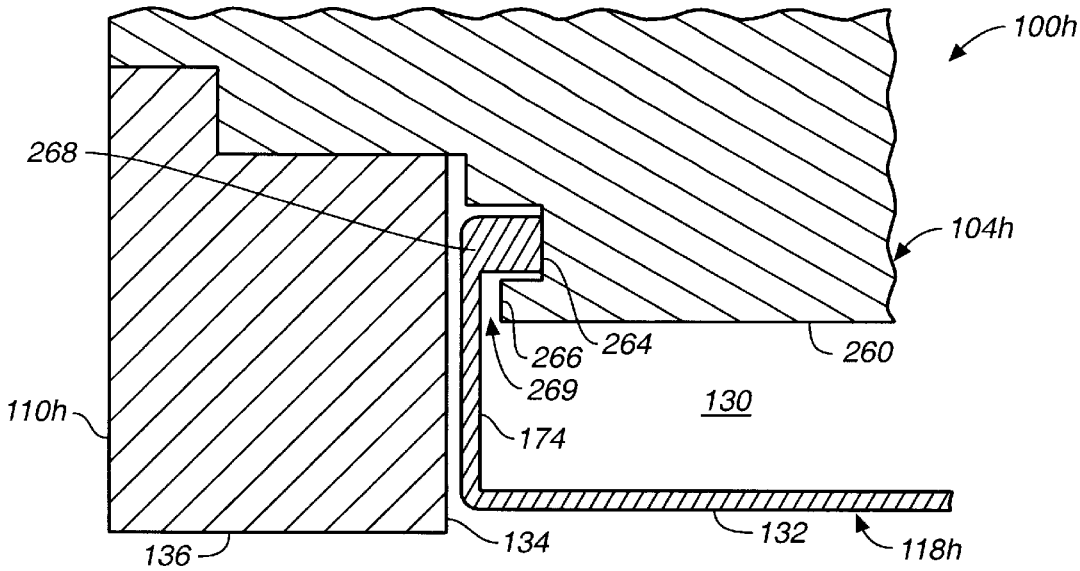
FIG. 7A is an enlarged view of the carrier head of FIG. 6 showing a snap-fit connection between the flexible membrane and the carrier base.

Referring to FIGS. 6 and 7A, a carrier head 100*h* includes a flexible membrane 118*h* which is snap-fit to a base 104*h*. Base 104*h* includes an annular projection 260 which extends downwardly from a main body portions 262. An annular groove or recess 264 is formed in an outer cylindrical surface 266 of projection 260. An edge portion 174*h* of flexible membrane 118*h* extends through a gap 269 between an inner surface 134*h* of retaining ring 110*h* and outer surface 266 of projection 260. Flexible membrane 118*h* includes a protruding rim portion 268 which fits into groove 264 on projection 260. In an unstretched state, the diameter of rim portion 268 may be slightly less than the diameter of groove 264. Thus, when flexible membrane 118*h* is stretched and pulled over annular projection 260 so that rim portion 268 fits in groove 264, the flexible membrane forms an O-ring seal with the base. Advantages of this embodiment may include ease of assembly, reduced risk of retaining ring distortion, a reliable fluid-tight seal between the base and the flexible membrane, and a low manufacturing cost.

Figure 7B:
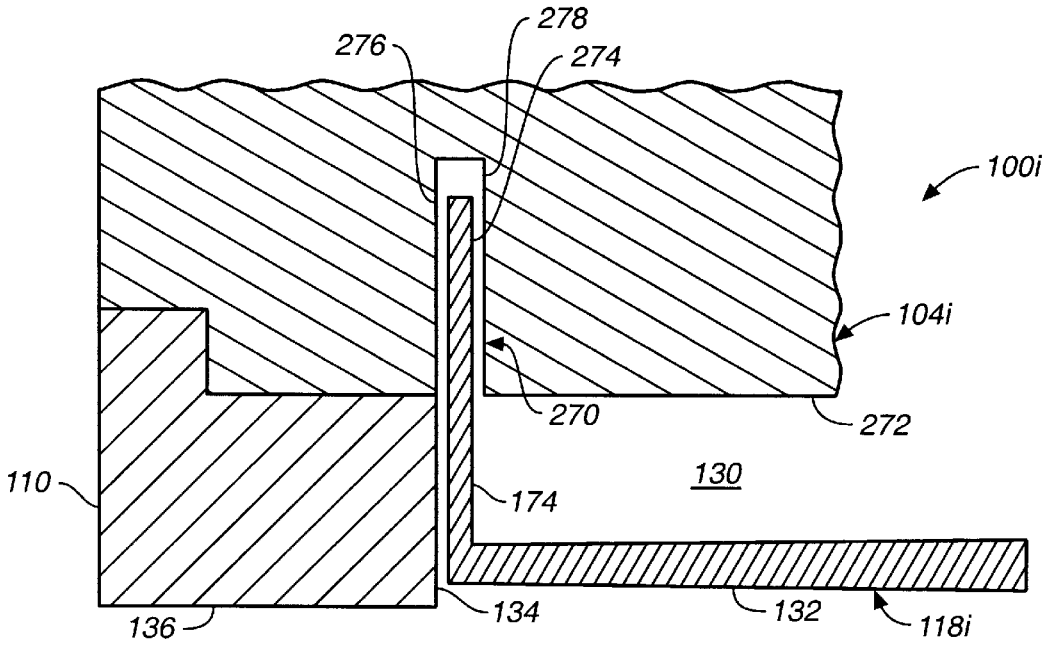
FIG. 7B is a cross-sectional view of a carrier head in which a flap of flexible membrane fits into a sealing slot in the carrier base.

Referring to FIG. 7B, carrier head 100*i* includes a generally vertical annular slot or recess 270 formed in a lower surface 272 of a base 104*i*. A flexible membrane 118*i* includes an edge or flap portion 274 that extends upwardly into annular slot 270. When chamber 130 is pressurized, flap portion 274 is urged outwardly against an outer sealing surface 276 of annular slot 270. On the other hand, if chamber 130 is evacuated, flap portion 274 is pulled against inner surface 278 of annular slot 270. Thus, a fluid-tight seal is formed between the flexible membrane and the base. Advantages of this embodiment may include the ability to remove the retaining ring without removing the membrane, ease of assembly, reduced risk of retaining ring distortion, accommodation of retaining ring wear, "self-alignment" of the membrane, and a low manufacturing cost.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a base;

a flexible membrane extending beneath the base to define a pressurizable chamber, a lower surface of the flexible membrane providing a mounting surface for a substrate;

a retaining ring having an inner surface surrounding the mounting surface and a recess formed in the inner surface, an edge portion of the flexible membrane extending into the recess; and a sealant in the recess to secure the flexible membrane to the retaining ring.

2. The carrier head of claim 1, wherein the sealant is injected in a liquid state into the recess.

3. The carrier head of claim 1, wherein a plurality of injection ports are formed between an upper surface of the retaining ring and the recess.

4. The carrier head of claim 1, wherein the flexible membrane extends along the inner surface of the retaining ring.

5. A carrier head for a chemical mechanical polishing apparatus, comprising:

a base;

a flexible membrane extending beneath the base to define a pressurizable chamber, a lower surface of the flexible membrane providing a mounting surface for a substrate; and a retaining ring including an inner surface surrounding the mounting surface and a recess formed in the inner surface, wherein an edge portion of the flexible membrane extends into the recess, the edge portion and recess configured such that if the chamber is pressurized, the edge portion is pressed against a first surface of the recess to form a seal between the flexible membrane and the retaining ring, and if the chamber is evacuated, the edge portion is pulled against a second surface of the recess to form a seal between the flexible membrane and the retaining ring.

6. The carrier head of claim 5, wherein the recess is generally horizontal.

7. The carrier head of claim 6, wherein the first surface is a top surface of the recess and the second surface is a bottom surface of the recess.

* * * * *